US005652057A

United States Patent [19]

Delker

[11] Patent Number: 5,652,057

[45] Date of Patent: Jul. 29, 1997

[54] HIGH STRENGTH CORE-SHEATH MONOFILAMENTS FOR TECHNICAL APPLICATIONS

[75] Inventor: Rex Delker, Wehringen, Germany

[73] Assignee: Hoechst Trevira GmbH & Co. KG, Germany

[21] Appl. No.: 625,713

[22] Filed: Mar. 28, 1996

[30] Foreign Application Priority Data

Mar. 31, 1995 [DE] Germany ..... 195 11 852.9

[51] Int. Cl.[6] ..... D02G 3/00; C08F 20/00

[52] U.S. Cl. ..... 428/373; 428/374; 525/440

[58] Field of Search ..... 428/373, 374; 525/440

[56] References Cited

U.S. PATENT DOCUMENTS

| | | | |
|---|---|---|---|
| 3,940,543 | 2/1976 | Chimura et al. | 428/373 |
| 4,405,686 | 9/1983 | Kuroda et al. | 428/374 |
| 4,477,636 | 10/1984 | Muroi et al. | 525/444 |
| 4,990,594 | 2/1991 | Cooke et al. | 528/272 |
| 5,082,731 | 1/1992 | Cooke et al. | 428/373 |
| 5,171,633 | 12/1992 | Muramoto et al. | 428/373 |
| 5,308,697 | 5/1994 | Muramoto et al. | 428/373 |

*Primary Examiner*—Newton Edwards
*Attorney, Agent, or Firm*—Connolly & Hutz

[57] ABSTRACT

Described are monofilaments with a core-sheath structure comprising a core of a thermoplastic polyester or copolyester and a sheath comprising a thermoplastic polyester, wherein the polyester or copolyester of the core has a melting point of 165° to 290° C., preferably of 220° to 240° C., and includes at least 70 mol %, based on the totality of all polyester structural units, of structural units derived from aromatic dicarboxylic acids and from aliphatic diols, and not more than 30 mol %, based on the totality of all polyester structural units, of dicarboxylic acid units which differ from the aromatic dicarboxylic acid units which form the predominant portion of the dicarboxylic acid units, and diol units derived from aliphatic diols and which differ from the diol units which form the predominant portion of the diol units, and the sheath comprises a polyester mixture comprising a thermoplastic polyester whose melting point is between 165° and 240° C., preferably 220° and 240° C., and a thermoplastic, elastomeric polyurethane with or without customary nonpolymeric additives. Also described are a process for producing the core-sheath monofilaments and their use in or for making textile sheet materials of high mechanical and chemical resistance.

25 Claims, No Drawings

HIGH STRENGTH CORE-SHEATH MONOFILAMENTS FOR TECHNICAL APPLICATIONS

BACKGROUND OF THE INVENTION

The present invention relates to high strength core-sheath monofilaments for technical applications, possessing high dimensional stability and abrasion resistance and very good heat and hydrolysis resistance, and also to technical products manufactured therefrom, in particular paper machine fabrics, fabrics for screen printing and for technical filter materials. The core-sheath monofilaments of this invention have a polyester core and a sheath comprising a mixture of a thermoplastic polyester and a thermoplastic elastomeric polyurethane.

Monofilaments for technical applications are in most cases subjected to high mechanical stresses in use. In addition there are in many cases thermal stresses and stresses due to chemical and other environmental effects to which the material must offer adequate resistance. Under all these stresses, the material has to have good dimensional stability and constancy of the stress-strain characteristics over prolonged use periods.

An example of technical applications requiring a combination of high mechanical, thermal and chemical resistance is the use of monofilaments in paper machine fabrics, in particular in the Fourdrinier. This use requires a monofilament material having a high initial modulus and a high breaking strength, good knot and loop strength and high abrasion resistance to withstand the high stresses and ensure adequate fabric life. For use in the drying section of the paper machine, the monofil, as well as meeting these parameters, is additionally acquired to have a high hydrolysis resistance.

The monofilament material has to meet similar requirements for use in screen printing fabrics, which should have long service lives under the constant stress of the high pressure of the squeegee, the hydrolytic attack of aqueous dye pastes and the action of high energy actinic light sources. The dimensional stability requirements of screen printing fabrics are particularly high to make possible the production of multicolor prints which are in register.

At present, paper machine fabrics for the forming and drying sections are predominantly fabricated from polyethylene terephthalate monofilaments in warp and weft. These fabrics have the disadvantage of becoming longer in the transport direction in the course of the fabric life in the paper machine and therefore require retensioning.

Screen printing fabrics are these days fabricated from relatively fine-denier monofilaments of polyethylene terephthalate or polyamide in warp and weft. The main disadvantage of polyamide fabrics is the high water regain, which has an adverse effect on the elasticity, which screen printing fabrics must possess to a very high degree; polyester screen printing fabrics have poorer elasticity characteristics from the start. As a result, such known screen printing fabrics achieve only relatively short service lives.

There has never been a shortage of attempts to produce synthetic monofilament materials suitable for durable paper machine fabrics and screen printing fabrics. However, the requirements which these technical products have to meet are so varied that hitherto only partial solutions have been achievable in this field. For instance, it is known to fabricate paper machine fabrics using monofilaments of polyphenylene sulfides. This material does possess very good mechanical stability combined with excellent hydrolysis stability. However, it has a markedly low resistance to actinic radiation, so that such a monofilament material is completely unsuitable for making screen printing fabrics. The object of using this polymer to prepare monofilaments which are usable in both technical fields has therefore not been achieved. Japanese Laid-Open Patent Specification No. 45741 (1991) discloses making screen printing fabrics from polyethylene naphthalate monofilaments which, owing to their higher modulus of elasticity (initial modulus), are said to be less prone to slackening. However, these filaments show an abnormal tendency to fibrillate on weaving. Japanese Laid-Open Patent Specification No. 5209 (1993) discloses core-sheath monofilaments intended for making screen printing fabrics. The core of these filaments is poly (ethylene 2,6-naphthalate), the sheath is polyethylene terephthalate or modified polyethylene terephthalate. The modified sheath polyester may contain for example isophthalic acid, adipic acid or sebacic acid radicals or longer-chain diol radicals such as diglycol, butanediol or polyethylene glycol radicals, in which case the polyethylene glycol radicals may have a molecular weight of about 600 to 1500. According to the illustrative embodiment, the sheath polyester may be for example a polyethylene terephthalate modified with 8% by weight of polyethylene glycol radicals. This amount of modifier is sufficient to influence the strength properties and the melting characteristics, but falls short of conferring elastomeric properties on the polyester.

It is also known that it is possible to produce polyester fibers having very different mechanical and textile properties. More particularly, it is possible, by variation of the spinning and stretch drawing and relaxation conditions, to use polyethylene terephthalate to produce monofilaments which cover a wide spectrum of the properties relevant for technical monofilaments.

However, the efforts to obtain a monofilament material which simultaneously combines the high dimensional stability, abrasion resistance and hydrolysis resistance required for paper machine fabrics with the high resistance to actinic light required for making screen printing fabrics have so far not been wholly successful.

In the desire to find a polyester fiber which is suitable for as many technical applications as possible there has been no shortage of attempts either to replace polyethylene terephthalate by other polyester building blocks and by copolyesters. Alternative polyesters which have already been investigated employ for example polyethylene naphthalate and copolyesters of 4,4'-biphenyldicarboxylic acid and 2,6-naphthalenedicarboxylic acid, as described for example in European Patent Application No. 202,631. Fibers formed from 4,4'-biphenyldicarboxylic acid and 2,6-naphthalenedicarboxylic acid are proposed in WO 93/02122. These fibers have a high longitudinal strength and a high modulus when spun with a high drawdown without any further afterstretch-drawing. However, the usefulness of this material for the production of monofilaments, in particular for making paper machine and screen printing fabrics, has to be doubted, since it is known from experience that a high modulus is generally accompanied by low transverse strength.

A copolyester of 4,4,-biphenyldicarboxylic acid and 2,6-naphthalenedicarboxylic acid and ethylene glycol which is said to be suitable for producing tire cord is described in Japanese Patent Application 50-135,333. This reference reveals that such a copolyester must not contain more than 20 mol % of 4,4'-biphenyldicarboxylic acid, since otherwise its initial modulus and its softening temperature decrease too much. This statement is supported in the reference by illustrative embodiments which show that the softening temperature, which is 275° C. for pure polyethylene naphthalate, drops to 238° C. for a copolyester containing about 25 mol % of 4,4,-biphenyldicarboxylic acid. It is also known that polymers of 4,4'-biphenyldicarboxylic acid crystallize extremely rapidly. This is another reason why the manufacturability of monofilaments using this raw material has to be doubted, since an overly rapid crystallization leads to early embrittlement of the monofilaments even during the actual manufacturing process, so that they break before adequate orientation has been achieved. German Patent Application P-43 28 029.3 likewise proposes producing monofilaments essentially from a mixture of poly(ethylene 2,6-naphthalate) and poly(ethylene biphenylene-4,4'-dicarboxylate). A further proposal for producing paper machine fabrics is found in German Patent Application P-44 10 399.9. According to this proposal, the fabrics shall be woven from monofilaments spun from an abrasion-resistant polyester mixture comprising a mixture of a thermoplastic polyester and a thermoplastic polyurethane. There is no mention in said patent application of the use of core-sheath monofilaments.

SUMMARY OF THE INVENTION

It has now been found that, surprisingly, it is possible to produce monofilaments which combine further improved mechanical application properties, high stability to actinic radiation and high chemical stability, in particular hydrolysis stability, and which are therefore available for a broader range of technical applications. These monofilaments consist essentially of polyesters—which for the purposes of the present invention shall also include copolyesters—and have a core-sheath structure.

The present invention accordingly provides monofilaments with a core-sheath structure comprising a core of a thermoplastic polyester or copolyester and a sheath comprising a thermoplastic polyester, wherein the polyester or copolyester of the core has a melting point of 165° to 290° C., preferably of 220° to 240° C., and includes at least 70 mol %, based on the totality of all polyester structural units, of structural units derived from aromatic dicarboxylic acids and from aliphatic diols, and not more than 30 mol %, based on the totality of all polyester structural units, of dicarboxylic acid units which differ from the aromatic dicarboxylic acid units which form the predominant portion of the dicarboxylic acid units or are derived from araliphatic dicarboxylic acids having one or more, preferably one or two, fused or unfused aromatic nuclei, or from cyclic or acyclic aliphatic dicarboxylic acids having in total 4 to 12 carbon atoms, preferably 6 to 10 carbon atoms, and diol units derived from aliphatic diols and which differ from the diol units which form the predominant portion of the diol units, or which are derived from branched and/or longer-chain diols having 3 to 10, preferably 3 to 6, carbon atoms, or from cyclic diols, or from diols which contain ether groups, or, if present in a minor amount, from polyglycol having a molecular weight of about 500–2000, and the sheath comprises a polyester mixture comprising a thermoplastic polyester whose melting point is between 165° and 240° C., preferably 220° and 240° C., and a thermoplastic, elastomeric polyurethane with or without customary non-polymeric additives.

DETAILED DESCRIPTION OF THE INVENTION

The proportion of the total cross-sectional area of the monofilament accounted for by the sheath is 5 to 95 preferably 10 to 60, in particular 15 to 35%, while the proportion accounted for by the core is 5 to 95 preferably 40 to 90, in particular 65 to 85%.

Preferably the polyester of the core, based on the totality of all polyester units, is composed of 35 to 50 mol % of units of the formula —CO—$A^1$—CO— (I)

0 to 15 mol % of units of the formula —CO—$A^2$—CO— (II)

35 to 50 mol % of units of the formula —O—$D^1$—O— (III)

0 to 15 mol % of units of the formula —O—$D^2$—O— (IV)

and 0 to 25 mol % of units of the formula —O—$A^3$—CO— (V)

where $A^1$ denotes aromatic radicals having 5 to 12, preferably 6 to 10, carbon atoms, $A^2$ denotes aromatic radicals differing from $A^1$ or araliphatic radicals having 5 to 16, preferably 6 to 12, carbon atoms or cyclic or acyclic aliphatic radicals having 2 to 10 carbon atoms, preferably 4 to 8 carbon atoms, $A^3$ denotes aromatic radicals having 5 to 12, preferably 6 to 10, carbon atoms, $D^1$ denotes alkylene or polymethylene groups having 2 to 4 carbon atoms or cycloalkane or dimethylenecycloalkane groups having 6 to 10 carbon atoms, $D^2$ denotes non-$D^1$ alkylene or polymethylene groups having 3 to 4 carbon atoms or cycloalkane or dimethylenecycloalkane groups having 6 to 10 carbon atoms or straight-chain or branched alkanediyl groups having 4 to 16, preferably 4 to 8, carbon atoms or radicals of the formula —$(C_2H_4—O)_m—C_2H_4$—, where m is an integer from 1 to 40, with m=1 or 2 being preferred for proportions of up to 20 mol % and groups with m=10 to 40 preferably being present only in proportions of below 5 mol %.

In a preferred core polyester, in the structural units of the polyester of the core, $A^1$ is 1,4-phenylene and $D^1$ is ethylene and in this polyester the structural units I and III preferably account for at least 85 mol %, in particular at least 90 mol %, of all structural units. In a further preferred core polyester, in the structural units of the polyester of the core, $A^1$ is 2,6-naphthylene and $D^1$ is ethylene and in this polyester the structural units I and III preferably account for at least 85 mol %, in particular at least 90 mol %, of all structural units.

In a further preferred embodiment of the present invention, in the structural units of the polyester of the core, $A^1$ is 2 6-naphthylene of the formula IV

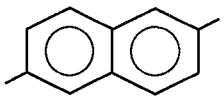

VI and 1,4-biphenyldiyl of the formula VII

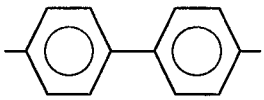

VII and $D^1$ is ethylene and in this polyester the structural units I and III preferably account for at least 85 mol %, in particular at least 90 mol %, of all structural units. It is further particularly advantageous if the 2,6-naphthylene and 1,4-biphenyldiyl groups $A^1$ are present in a molar ratio of not more than 3:1, preferably in a molar ratio between 6:4 and 4:6.

Preference is likewise given to core polyesters wherein in the structural units of the polyester of the core, $A^1$ is 1,4-phenylene and $D^1$ is 1,4-bismethylenecyclohexane and in this polyester the structural units I and III preferably account for at least 85 mol %, in particular at least 90 mol %, of all structural units.

Advantageously, the polyester of the core has a specific viscosity of 0.55 to 1.6, preferably of 0.58 to 1.5, measured in a 1% strength by weight solution of the polyesters in dichloroacetic acid at 25° C.

The polyesters of various chemical compositions can have the same average molecular weight and/or the same spinnability and/or filament strength while having different specific viscosities. For instance, the specific viscosities of good filament-forming polyesters based essentially on polyethylene naphthalate range from 0.55 to 0.8. For polyethylene terephthalate and its copolyesters the range extends from 0.7 to 1.0, for poly-(1,4-bismethylenecyclohexane terephthalate) and its modifications the range extends from 1.15 to 1.5, and for polybutylene terephthate and its modifications the range extends from 1.1 to 1.3 with particular advantage. By "its modifications" are meant those polyesters which, as well as the main components mentioned, contain in the molecule up to 15 mol % of the abovementioned modifying structural units.

The polymer material of the polyester mixture of the sheath contains 1 to 99% by weight, preferably 30 to 90%, in particular 50 to 80% by weight, of the thermoplastic polyester and 1 to 99% by weight, preferably 10 to 70% by weight, in particular 20 to 50% by weight, of the thermoplastic polyurethane. Here it is surprising that even very small additions of the elastomeric, thermoplastic polyurethane bring about significant improvements in the application properties. It is therefore frequently sufficient to use very low addition levels within the above-specified range. This results in a price advantage for the monofilament of this invention, since the elastomeric additions are relatively costly materials. As for the rest, it will be appreciated that the amount of elastomer to be added is determined according to the requirements of the specific application within the framework of the above quantitative specifications.

Preferably the polyester of the polyester mixture of the sheath has a glass transition point within the range from 60° to 120° C., in particular from 70° to 85° C., a crystallization point within the range from 135° to 155° C., in particular from 140° to 150° C., and a melting point within the range from 165° C. to 240° C., in particular from 220° to 240° C.

Advantageously the polyester of the polyester mixture of the sheath has a melt viscosity of 445 to 482 Pa·s, preferably of 455 to 475 Pa·s, in particular of 460 to 468 Pa·s, when measured at 245°±2° C. and a shear gradient of 200±5 $s^{-1}$ and of 245 to 282 Pa·s, preferably of 250 to 272, in particular of 255 to 270 Pa·s when measured at the same temperature with a shear gradient of 1200±5 $s^{-1}$.

The polyester of the polyester mixture of the sheath contains at least 70 mol %, based on the totality of all polyester structural units, of structural units derived from aromatic dicarboxylic acids and from aliphatic diols, and not more than 30 mol %, based on the totality of all polyester structural units, of dicarboxylic acid units which differ from the aromatic dicarboxylic acid units which form the predominant portion of the dicarboxylic acid units or are derived from araliphatic dlcarboxylic acids having one or more, preferably one or two, fused or unfused aromatic nuclei, or from cyclic or acyclic aliphatic dicarboxylic acids having in total 4 to 12 carbon atoms, preferably 6 to 10 carbon atoms, and diol units derived from aliphatic diols and which differ from the diol units which form the predominant portion of the diol units, or from branched and/or longer-chain diols having 3 to 10, preferably 3 to 6, carbon atoms, or from cyclic diols, or from diols which contain ether groups or, if present in a minor amount, from polyglycol having a molecular weight of about 500–2000.

Preferably the polyester of the polyester mixture of the sheath, based on the totality of all polyester structural units, is composed of 35 to 50 mol % of units of the formula —CO—$A^1$—CO— (I)

0 to 15 mol % of units of the formula —CO—$A^2$—CO— (II)

35 to 50 mol % of units of the formula —O—$D^1$—O— (III)

0 to 15 mol % of units of the formula —O—$D^2$—O— (IV)

and 0 to 25 mol % of units of the formula —O—$A^3$—CO— (V)

where $A^1$ denotes aromatic radicals having 5 to 12, preferably 6 to 10, carbon atoms, $A^2$ denotes aromatic radicals differing from $A^1$ or araliphatic radicals having 5 to 16, preferably 6 to 12, carbon atoms or cyclic or acyclic aliphatic radicals having 2 to 10 carbon atoms, preferably 4 to 8 carbon atoms, $A^3$ denotes aromatic radicals having 5 to 12, preferably 6 to 10, carbon atoms, $D^1$ denotes alkylene or polymethylene groups having 2 to 4 carbon atoms or cycloalkane or dimethylenecycloalkane groups having 6 to 10 carbon atoms, $D^2$ denotes non-$D^1$ alkylene or polymethylene groups having 3 to 4 carbon atoms or cycloalkane or dimethylenecycloalkane groups having 6 to 10 carbon atoms or straight-chain or branched alkanediyl groups having 4 to 16, preferably 4 to 8, carbon atoms or radicals of the formula —$(C_2H_4—O)_m—C_2H_4$—, where m is an integer from 1 to 40, with m=1 or 2 being preferred for proportions of up to 20 mol % and groups kith m=10 to 40 preferably being present only in proportions of below 5 mol %.

Particularly preferably in the structural units of the polyester of the polyester mixture of the sheath, $A^1$ denotes 1,4-phenylene and 1,3-phenylene and $D^1$ denotes ethylene, the molar ratio of 1,4- and 1,3-phenylene being such that the polyester has a melting point within the range from 220° to 240° C.

It is further preferred when the polyester present in the polyester mixture of the sheath likewise has a specific viscosity of 0.55 to 1.6, preferably of 0.58 to 1.5, measured in a 1% strength by weight solution of the polyesters in dichloroacetic acid at 25° C., and/or when not only the polyester of the core but also the polyester present in the polyester mixture of the sheath has a melting point between 220° to 240° C.

It is further particularly preferable, especially with regard to the core-sheath adhesion, for the polyester of the core and the polyester of the polyester mixture of the sheath to have the same chemical composition.

It is of particular advantage for the chemical stability, in particular to hydrolysis, of the monofilaments of this invention when the polyester of the core and the polyester of the polyester mixture of the sheath contain not more than 60 meq/kg, preferably less than 30 meq/kg, of capped carboxyl end groups and less than 5 meq/kg, preferably less than 2 meq/kg, in particular less than 1.5 meq/kg, of free carboxyl end groups. Preferably, therefore, the polyester of the core and the polyester of the polyester mixture of the sheath have carboxyl end groups capped by reaction with mono- or bis- and/or polycarbodiimides. In a further embodiment, preferred because of the prolonged hydrolysis stability, the polyester of the core and the polyester of the polyester mixture of the sheath include not more than 200 ppm, preferably not more than 50 ppm, in particular from 0 to 20 ppm, of mono- and/or biscarbodiimides and 0.02 to 0.6% by weight, preferably 0.05 to 0.5% by weight, of free polycarbodiimide having an average molecular weight of 2000 to 15000, preferably of 5000 to 10000. Suitable hydrolysis stabilizers based on carbodiimide are for example the ®Stabaxol grades from Bayer AG.

The novel core-sheath monofilaments consisting of the above-described polyesters, especially polyethylene terephthalate, are not readily flammable.

The low flammability may be additionally enhanced by using flame retardant modified polyesters. Such flame retardant modified polyesters are known. They contain additions of halogen compounds, in particular bromine compounds, or, particularly advantageously, they contain phosphorus compounds cocondensed into the polyester chain. Particularly preferred flame retardant pile materials of this invention include in the backing and/or pile yarns composed of polyesters containing, cocondensed in the chain, units of formula VIII

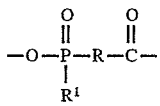

(VIII)

where R is alkylene or polymethylene having 2 to 6 carbon atoms or phenyl and $R^1$ is alkyl having 1 to 6 carbon atoms, aryl or aralkyl. Preferably, in the formula VIII, R is ethylene and $R^1$ is methyl, ethyl, phenyl or o-, m- or p-methylphenyl, in particular methyl. The units of the formula VIII are advantageously present in the polyester chain in a proportion of up to 15 mol %, preferably 1 to 10 mol %. An agent suitable for introducing a group of the formula VIII is the commercial product ®Phospholan from Hoechst AG.

The aromatic rings of the polyester of the core and of the polyester of the polyester mixture of the sheath can be unsubstituted or carry one or two nonreactive substituents, depending on the properties which are desired. Suitable substituents are halogen atoms, preferably fluorine or chlorine, lower alkyl groups having up to 4 carbon atoms, such as, for example, methyl, ethyl, n-butyl, isobutyl or tert-butyl, preferably methyl, lower alkoxy groups having up to 4 carbon atoms, such as, for example, methoxy, ethoxy or butoxy, preferably methoxy, or the sulfo group $—SO_3H$.

The elastomeric polyurethane of the polyester mixture of the sheath preferably has a shear modulus of 8 to 80 MPa, preferably 20 to 50 MPa, within the temperature range from 20 to 60° C., a mechanical loss factor tan(δ) of $0.8\times10^{-2}$ to $1.2\times10^{-1}$ within the temperature range from 20° to 60° C., a DIN 53505 Shore hardness A of 82 to 100, a DIN 53505 Shore hardness D of 30 to 60, a DIN 53504 tensile strength of 32 to 42 MPa, a DIN 53504 breaking extension of 420 to 520%, and a DIN 53515 impact toughness of 32 to 45%.

The elastomeric polyurethane of the polyester mixture of the sheath preferably conforms to the idealized formula IX

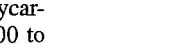

(IX)

where $R^1$ is a bivalent aromatic or araliphatic radical having 6 to 18 carbon atoms with a substituted or unsubstituted aromatic ring or with two fused or unfused, substituted or unsubstituted aromatic rings, $R^2$ is a polyether unit of the formula X

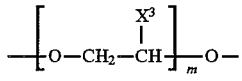

(X)

where $X^3$ is hydrogen or methyl, and m is from 10 to 100, preferably from 10 to 30, or $R^2$ is the radical of polytetrahydrofuran or preferably a unit of the formula XI

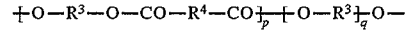

(XI)

where $R^3$ is straight-chain or optionally branched alkanediyl or oxyalkanediyl having 2 to 8, preferably 2 to 6, carbon atoms, such as, for example, ethylene, 1,3-propanediyl, 1,4-butanediyl, 1,6-hexanediyl, 2-ethyl-1,6-hexanediyl, 2,2-dimethyl-1,3-propanediyl or the bivalent oxaalkanediyl radicals derived from diethylene glycol or triethylene glycol, $R^4$ is alkanediyl having 2 to 6, preferably 2 to 4, carbon atoms, cycloalkanediyl such as 1,4- or 1,3-cyclohexanediyl or a bivalent aromatic radical having 6 to 12 carbon atoms, preferably 6 to 10 carbon atoms, in particular 1,3- or 1,4-phenylene, p is a number chosen such that the polyester unit of the formula (XI) has a molecular weight of 1000 to 2000 (p=5 to 12, preferably 8 to 11) and q is either 0 or 1.

Alternatively, the elastomeric polyurethane of the polyester mixture of the sheath preferably conforms to the idealized formula IX where $R^1$ is phenylene, naphthalene or a structural unit of the formulae XII or XIII

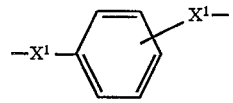

XII

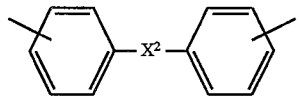

XIII with or without substituents, where $X^1$ is a bivalent aliphatic radical having 1 to 3 carbon atoms and $X^2$ is a direct bond, a bivalent aliphatic radical having 1 to 3 carbon atoms, —CO—, $—SO_2—$ or —NH—CO—NH—.

In a further alternative, the elastomeric polyurethane of the polyester mixture of the sheath preferably conforms to the idealized formula VI where $R^1$ is a structural unit of the formula XIV

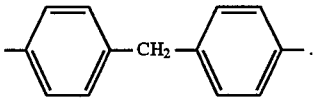

(XIV)

The aromatic rings present in an elastomeric polyurethane of the polyester mixture of the sheath which conforms to the idealized formula IX can be unsubstituted or carry one or two substituents selected from the group consisting of $—SO_3H$ and $—CH_3$ to modify the properties of the polyurethane.

A commercially available polyurethane which is suitable for preparing the polyester mixture of the sheath of the core-sheath monofilaments of this invention is Bayer AG's ®Desmopan.

The monofilaments of this invention advantageously have a linear density of 1 to 24400 dtex (corresponding to filament diameters of 10 to 1500 μm for a round cross section) and a round, elliptical or n-cornered cross-sectional shape, an elliptical shape having a ratio of major axis to minor axis of up to 10:1 and n being ≧4, preferably 4 to 8.

Preferably the core-sheath monofilaments of this invention additionally have the following features, which can be present singly or combined: an initial modulus at 25° C. of above 10, preferably of above 12, N/tex, a tenacity of above 18 cN/tex, preferably of 20 to 45 cN/tex, a 180° C. dry heat shrinkage of above 0.5%, preferably 1 to 25%. The initial modulus for the purposes of this invention is the gradient of the secant of the stress-strain diagram between the points of 0.3% and 0.5% strain. Particularly characteristic initial moduli range from 15 to 25 N/tex.

The tenacity elongation is generally within the range of above 7%, preferably from 8 to 18%.

In addition to the above-described copolyester, the monofilaments of this invention may include small amounts of admixtures and additives which are nonpolymeric in nature, such as, for example, catalyst residues, modifiers, fillers, delustrants, pigments, dyes, stabilizers, such as UV absorbers, antioxidants, hydrolysis, light and temperature stabilizers and/or processing aids, plasticizers or lubricants. These additives are customarily present in a concentration of not more than 10% by weight, preferably 0.01–5% by weight, in particular 0.01–2% by weight. The catalyst residues can be for example antimony trioxide or tetraalkoxytitanates. As processing aids or lubricants it is possible to use siloxanes, in particular polymeric dialkyl- or diarylsiloxanes, salts and waxes and also longer-chain organic carboxylic acids, i.e. those having more than 6 carbon atoms, aliphatic, aromatic and/or perfluorinated esters and ethers in amounts of up to 1% by weight. The monofilaments may also include inorganic or organic pigments or delustrants, such as, for example, organic color pigments or titanium dioxide, or carbon black as a colorant or conductor. Stabilizers used include for example phosphorus compounds, such as, for example, phosphoric esters, and may additionally include, if necessary, viscosity modifiers and substances for modifying the crystallite melting point and/or the glass transition temperature or those which affect the crystallization kinetics and/or the degree of crystallization. Viscosity modifiers used include for example polybasic carboxylic acids and esters, such as trimesic acid or trimellitic acid, or polyhydric alcohols, such as, for example, diethylene glycol, triethylene glycol, glycerol or pentaerythritol. These compounds are either mixed into the finished polymers in a small amount or, preferably, added in the desired amount as copolymerization components in the preparation of the polymers.

Particular advantages for technical use result when the polyester of the core and/or the polyester mixture of the sheath have different colors. The difference in coloring can be achieved as a result of the fact that the polyester of the core and/or the polyester mixture of the sheath contain different dyes or as a result of the fact that either the polyester of the core or the polyester mixture of the sheath contain up to 5% by weight of a dye and the other filament constituent is ecru-colored. Advantageously, the dye in the core and/or sheath of the monofilaments is a dye which is soluble in the polyester or a pigment. The difference in the color of core and sheath of the monofilaments of this invention has the effect that the color of the monofilaments will change with a certain degree of wear.

The present invention further provides a process for producing the above-described core-sheath monofilaments of this invention, which comprises steps wherein thermoplastic polyester for the core and a polyester mixture for the sheath are separately melted in separate extruders and extruded at melt temperatures of 185° to 320° C., preferably of 210° to 270° C., with a drawdown of 1:1.5 to 1:5, preferably 1:2 to 1:3, cooled down in a spin bath and wound up or taken off, and the filament thus produced is subsequently subjected to an afterdraw in total draw ratio of 1:4 to 1:8 and subsequently heat-set at temperatures of 160° to 250° C. at constant length or with a permitted shrinkage of 2 to 30%.

In this process, the polyester or copolyester used for the core has a melting point of 165° to 290°, preferably of 220° to 240° C., and includes at least 70 mol %, based on the totality of all polyester structural units, of structural units derived from aromatic dicarboxylic acids and from aliphatic diols, and not more than 30 mol %, based on the totality of all polyester structural units, of dicarboxylic acid units which differ from the aromatic dicarboxylic acid units which form the predominant portion of the dicarboxylic acid units or are derived from araliphatic dicarboxylic acids having one or more, preferably one or two, fused or unfused aromatic nuclei, or from cyclic or acyclic aliphatic dicarboxylic acids having in total 4 to 12 carbon atoms, preferably 6 to 10 carbon atoms, and diol units derived from aliphatic diols and which differ from the diol units which form the predominant portion of the diol units, or which are derived from branched and/or longer-chain diols having 3 to 10, preferably 3 to 6, carbon atoms, or from cyclic diols, or from diols which contain ether groups, or, if present in a minor amount, from polyglycol having a molecular weight of about 500–2000. The sheath is formed using a polyester mixture comprising a thermoplastic polyester whose melting point is between 165° and 240° C., preferably 220°0 and 240° C., and a thermoplastic, elastomeric polyurethane with or without customary nonpolymeric additives.

The extruding can take place through a special spinneret for the production of core-sheath filaments, having a central orifice and one or more peripheral sheath orifices. The melts for core and sheath are then filtered in separate spin packs, the thermoplastic polyester is fed to the core orifice and the abrasion-resistant polyester mixture to the sheath orifice of a spinneret for producing, core-sheath monofilaments. In another, very advantageous embodiment of the process of this invention, the core polyester is fed to the center and the polyester mixture for the sheath of the monofilament to the periphery of a spin pack and extruded through a single spinning orifice. This technology is described in detail in EP-A-0 434 448. It leads to core-sheath monofilaments having particularly good core-sheath adhesion.

Advantageously, the polymer components for the core—which contain any nonpolymeric constituents present—are combined with each other in the desired mixing ratio immediately before entry into the extruder and the homogenization is carried out in the intake and mixing regions of the extruder screw. To produce particularly hydrolysis-stable core-sheath monofilaments according to this invention, the polyesters of the core and the polyester mixture of the sheath are admixed before spinning with 1.0 to 1.2 times the amount equivalent to the amount of free carboxyl end groups present therein of mono-, bis- and/or polycarbodiimides. It is in this connection of particular advantage for the long-term stability if the polyesters of the core and the polyester mixture of the sheath are admixed before spinning with an amount of not more than 0.6% by weight of a mono- and/or biscarbodiimide and not less than 0.05% by weight of a polycarbodiimide.

With this measure it is again advantageous for the addition of the mono-, bis- and/or polycarbodiimides to take place immediately before extrusion, so that the contact time between molten polyester and added carbodiimide is less than 5, preferably less than 3, minutes. Preferably the spinning is carried out at a melt temperature within the range from 210° to 250° C. and the monofilaments are taken off at a spinning take-off speed of 5 to 30 m per minute.

The spinning temperature and the drawdown, which can be fixed by setting the extrusion rate and the spinning take-off speed, and also the stretch-drawing conditions are chosen so that the monofilaments of this invention have the following parameters: an initial modulus at 25° C. of above 10, preferably of above 12, N/tex, a tenacity of above 18, preferably of 20 to 45 cN/tex, a tenacity elongation of above 7, preferably of 8 to 18% and a 180° C. dry heat shrinkage of above 0.5%, preferably 1 to 25%.

The exact determination of the composition and spinning parameters for achieving a certain combination of monofilament properties can be routinely carried out by determining the dependence of the contemplated monofilament property on the composition of the polyester and on the spinning parameters mentioned.

The polyesters and copolyesters are prepared by polycondensation of the corresponding dicarboxylic acid and diol components, advantageously by first polycondensing in the melt to an intermediate IV value and then further condensing in the solid state to the desired final viscosity. Dicarboxylic acid and diol components should advantageously be present in roughly equal molar values. However, if it is advantageous, for example in order to influence the reaction kinetics, it is also possible for one of the two components, preferably the diols, to be used in excess. The excess diol is then distilled off in the course of the polycondensation. The polycondensation is carried out on the lines of customary processes by, for example, starting from 50 mol % of the corresponding dicarboxylic acids and/or dialkyl dicarboxylates, such as the dimethyl or diethyl carboxylates, and ≧50 mol % of the diol, which is initially heated to about 200° C., if appropriate in the presence of a transesterification catalyst, until sufficient methyl or ethyl alcohol has been distilled off to form a low molecular weight oligo-or polyester. This low molecular weight ester is then polycondensed in a second stage in the molten state at a reaction temperature of about 240°–290° C. in the presence of a polycondensation catalyst to form a higher molecular weight polyester. This polycondensation is carried on to an IV of about 0.5 to 0.8 dl/g. The catalysts used can be the catalysts customarily used for polycondensations, such as Lewis acids and bases, polyphosphoric acid, antimony trioxide, titanium tetraalkoxides, germanium tetraethoxide, organophosphates, organophosphites and mixtures thereof, in which case a mixture of triphenyl phosphates and antimony trioxide, for example, is preferred. If the introduction of units of the formula VIII is desired, the polycondensation bath is admixed with up to 15 mol % of a carboxyphosphinic acid derivative, for example ®Phospholan from Hoechst AG. In general, the polycondensation in the melt takes less than 10 hours, preferably 2–3 hours. For the subsequent solid state polycondensation, the low molecular weight ester prepared in the first stage is finely pulverized or pelletized and the temperature is controlled within the range from 220° to 270° C. so that the polyester powder or the polyester pellets never agglomerate or sinter together or even melt. Following the solid state polycondensation, which is carried on to the desired value of the specific viscosity, the high molecular weight copolyester is melt-spun in a conventional manner to form the monofilaments of this invention.

The copolyester is dried immediately before spinning, preferably by heating in a dry atmosphere or under reduced pressure.

The core-sheath monofilaments of this invention are used with particular advantage in or for making textile sheet materials of high mechanical and chemical resistance.

Such a technical use for the core-sheath monofilaments of this invention is the manufacture of paper machine fabrics. The present invention accordingly provides for the use of the core-sheath monofilaments of this invention in or for making paper machine fabrics, and also provides paper machine fabrics which consist predominantly, i.e. to not less than 65% by weight, of the above-described monofilaments, specifically not only paper machine forming fabrics (Fourdriniers) but also paper machine drying fabrics. A paper machine forming fabric according to this invention generally has a single- to three-ply construction and a basis weight of 100 to 800, preferably 200 to 600, g/m$^2$. It is generally constructed using core-sheath monofilaments according to this invention which have a diameter of 0.08 to 0.45 mm, preferably 0.13 to 0.30 mm. Paper machine drying fabrics are generally constructed using core-sheath monofilaments according to this invention which have a diameter of 0.20 to 1.00 mm, preferably of 0.40 to 0.8 mm. The monofilaments are woven up to the paper machine fabrics on conventional full-width weaving machines using the machine parameters customary in the weaving of polyethylene terephthalate, too. For instance, good paper machine fabric material is obtained on weaving monofils having a diameter of 0.017 mm in the warp with face wefts of 0.2 mm and back wefts of 0.22 mm. The fabric possesses very good dimensional stability and excellent abrasion resistance. The fabric obtained is generally aftertreated on an appropriately dimensioned heat-setter in order that the specific paper machine fabric properties desired in an individual case may be conferred.

The paper machine fabric produced in this way from monofilaments of this invention has better dimensional stability warpways and weftways compared with material produced from conventional polyethylene terephthalate monofilaments and is smoother running in the paper machine as a result, which is beneficial to the quality of the paper produced.

A particular form of paper machine fabrics are spiral fabrics. These fabrics consist of a multiplicity of monofilament spirals (helices) arranged side by side with their axes in a parallel arrangement, the pitch of the helices or spirals being at least twice the thickness of the monofilament and the distance between adjacent spirals being such that the helices intermesh. A polyester monofilament "wire" is pushed into the space formed by the helices of the two intermeshing spirals to join neighboring spirals together. Additionally, a filling wire can be pushed into the space left in the center of each spiral.

The core-sheath monofilaments of this invention, representing an advantageous combination of good mechanical properties, in particular very good abrasion resistance, and high chemical stability, can also be used in or for making such spiral fabrics. The present invention accordingly further provides the use of the novel core-sheath monofilaments in or for making spiral fabrics and also spiral fabrics consisting predominantly, i.e. at least 65% by weight, of the above-described monofilaments. Generally, the spirals are produced using novel core-sheath monofilaments having a diameter of 0.4 to 1.0 mm, preferably 0.5 to 0.8 mm. The joining wires of these fabrics are advantageously produced from novel core-sheath monofilaments having a diameter of 0.5 to 1.5 mm, preferably 0.6 to 1.2 mm.

The present invention further provides for the use of the above-described novel core-sheath monofilaments in or for making screen printing fabrics and the resulting screen printing fabrics comprising a proportion of the novel core-sheath monofilaments which will have a significant bearing on the properties of the screen printing fabrics.

Such a screen printing fabric generally has—depending on the diameter of the interwoven monofilaments—a basis weight of 10 to 200, preferably 20 to 100, g/m$^2$. The novel core-sheath monofilaments used generally have a diameter of 10 to 100 μm (corresponding to about 1 to 110 dtex), preferably of 10 to 80 μm (corresponding to about 1 to 70 dtex), in particular having a diameter of 20 to 35 μm (corresponding to about 5 to 35 dtex). Particular preference for the forming of the screen printing fabrics is given to those core-sheath monofilaments of the invention whose sheath and optionally also whose core includes 0.1 to 2.0% by weight of a dye and 0.1 to 0.5% by weight of a UV absorber and less than 0.3% by weight of $TiO_2$.

The novel core-sheath monofilaments are woven up to the screen printing fabrics on customary weaving machines using machine parameters customary for the weaving of polyethylene terephthalate, too.

For instance, good screen printing material is obtained on plain or twill weaving monofils 0.040 mm in diameter in warp and weft. Owing to the high modulus of elasticity of the monofilaments of this invention, the fabric, compared with conventional polyester screen printing fabrics, has distinctly superior, very good dimensional stability and abrasion resistance and hence a longer life in the screen printing machine even under severe conditions. In many cases, the material of this invention can substitute screen printing fabrics which to date are still fabricated from metal wire.

Core-sheath monofilaments of this invention can also be used with advantage for producing mechanically and chemically outstandingly stable filter materials. The present invention accordingly further provides for the use of the core-sheath monofilaments of this invention in or for making filter materials and also the resulting filter materials comprising a proportion of the novel core-sheath monofilaments which significantly influences the properties of the filter material.

Further, the core-sheath monofilaments of this invention can also be used with advantage to produce mechanically and chemically outstandingly stable, high strength and dimensionally stable conveyor belts or reinforcing layers for conveyor belts. The present invention accordingly further provides for the use of the core-sheath monofilaments of this invention in or for making conveyor belts and the resulting conveyor belts comprising a proportion of the novel core-sheath monofilaments which significantly influences the properties of the conveyor belt.

EXAMPLE 1

A 1 l three-necked flask equipped with nitrogen inlet and outlet, thermometer, descending condenser and mechanical stirrer is charged with 420 g of dimethyl terephthalate, 47 g of dimethyl isophthalate, 367 g of ethylene glycol and 0.7 g of manganese acetate tetrahydrate. The mixture was heated at 220° C. for 2.5 hours to distill off methanol. Thereafter 0.675 g of triphenyl phosphate and 0.226 g of antimony trioxide were added as polycondensation catalyst. The mixture was then heated with stirring to 270° C., a vacuum was applied, the temperature was raised to 290° C., and the batch was held at that temperature for 2.5 hours. The polyester thus obtained has an average molecular weight of intermediate magnitude; it is used as intermediate for preparing a high molecular weight polyester by solid state condensation. For this, the polyester is pulverized so that it would pass through a 20 mesh sieve. The powder is then further polycondensed under reduced pressure at 220° C. in the solid state for 24 hours until it has reached a mean molecular weight which corresponds to a specific viscosity ($V_s$) of 1.37, measured in a 1% strength by weight solution in dichloroacetic acid at 25° C. The polyester thus obtained has a carboxyl end group concentration of 13 meq/kg.

The same method can also be used to obtain an even more flame-retardant polyester if, after the elimination of methanol, the batch is admixed with 5% by weight of 2-carboxyethylmethylphosphinic anhydride (®Phospholan from Hoechst AG).

EXAMPLE 2

A) 700 g of an isophthalic acid-modified polyethylene terephthalate prepared as described in Example 1 ($V_s$=1.37) were granulated and vacuum-dried overnight and thoroughly mixed with 300 g of a similarly vacuum-dried commercially available elastomeric polyurethane (®Desmopan VPKA 8392 from Bayer AG).

B) 300 g of an isophthalic acid-modified polyethylene terephthalate prepared as described in Example 1 ($V_s$=1.37) were vacuum-dried overnight. The subsequent production of core-sheath monofilaments took place in a spinning facility as described in EP-A-0 434 448. In this facility, each spinning orifice has a feed for the core melt, located centrally above the exit orifice, and a feed slot for the sheath melt, forming a circle around the spinning bore. In this way, the central stream of the core material is surrounded with the sheath mixture melt supplied on all sides.

The polyester mixture prepared as per section A of this example is melted in an extruder at 240° C., and the melt is forced by means of a metering pump into a spin pack. Following filtration in the spin pack, the melt of the mixture is fed to the peripheral sheath feeds of the abovementioned spinnerets for the production of core-sheath monofilaments. In a separate line of extruder, metering pump and spin pack, the polyester dried as per section B of this example is melted, filtered and fed to the central core feeds of the spinnerets. The melt streams were extruded in a weight ratio of 25% by weight of sheath mixture and 75% by weight of core polyester at a melt temperature of 240° C. and a total throughput of 20 g/min per spinning orifice through spinning orifices having a diameter of 0.7 mm, corresponding to a drawdown of 2.0, and quenched in a water bath. The take-off speed was 12.5 m/min. Subsequently the resulting core-sheath monofilaments were continuously stretch-drawn in two stages at 190° C. in the first stage and 175° C. in the second stage, the draw ratio being 1:6.0 in the first stage and 1:1.13 in the second stage, and set at 215° C. in a duct 4 m in length.

EXAMPLE 3

Example 2 was repeated with the metered addition into the mixing zone of each extruder—based on the respective throughput—of 0.29% by weight of N,N'-di-p-tolylcarbodiimide and 0.2% by weight of 1,5-dimethylbenzene-2,4-polycarbodiimide.

The properties of the core-sheath monofilaments thus obtained are similar to those produced in Example 2, except that the hydrolysis resistance is distinctly improved.

We claim:

1. Monofilaments with a core-sheath structure comprising a core of a thermoplastic polyester or copolyester, wherein the polyester or copolyester of the core has a melting point of 165° to 290° C., and includes at least 70 mol %, based on the totality of all polyester structural units, of structural units derived from aromatic dicarboxylic acids and from aliphatic diols, and not more than 30 mol %, based on the totality of all polyester structural units, of dicarboxylic acid units which differ from the aromatic dicarboxylic acid units which form the predominant portion of the dicarboxylic acid units or are derived from araliphatic dicarboxylic acids having one or more fused or unfused aromatic nuclei, or from cyclic or acyclic aliphatic dicarboxylic acids having in total 4 to 12 carbon atoms, and diol units derived from aliphatic diols and which differ from the diol units which form the predominant portion of the diol units, or which are derived from branched or longer-chain diols having 3 to 10 or from cyclic diols, or from diols which contain ether groups, or from polyglycol having a molecular weight of about 500–2000, and a sheath comprising a polyester mixture including a thermoplastic polyester whose melting point is between 165°0 and 240° C., and a thermoplastic, elastomeric polyurethane.

2. The monofilaments of claim 1 wherein the proportion of the total cross-sectional area of the monofilament accounted for by the sheath is 5 to 95% while the proportion accounted for by the core is 5 to 95%.

3. The monofilaments of claim 1 wherein the polyester of the core, based on the totality of all polyester units, is composed of 35 to 50 mol % of units of the formula —CO—$A^1$—CO— (I)

0 to 15 mol % of units of the formula —CO—$A^2$—CO— (II)

35 to 50 mol % of units of the formula —O—$D^1$—O— (III)

0 to 15 mol % of units of the formula —O—$D^2$—O— (IV)

and 0 to 25 mol % of units of the formula —O—$A^3$—CO— (V)

where $A^1$ denotes aromatic radicals having 5 to 12 carbon atoms, $A^2$ denotes aromatic radicals differing from $A^1$ or araliphatic radicals having 5 to 16 carbon atoms or cyclic or acyclic aliphatic radicals having 2 to 10 carbon atoms, $A^3$ denotes aromatic radicals having 5 to 12 carbon atoms, $D^1$ denotes alkylene or polymethylene groups having 2 to 4 carbon atoms or cycloalkane or dimethylenecycloalkane groups having 6 to 10 carbon atoms, $D^2$ denotes non-$D^1$ alkylene or polymethylene groups having 3 to 4 carbon atoms or cycloalkane or dimethylenecycloalkane groups having 6 to 10 carbon atoms or straight-chain or branched alkanediyl groups having 4 to 16 carbon atoms or radicals of the formula —$(C_2H_4—O)_m—C_2H_4$—, where m is an integer from 1 to 40, with m=1 or 2 for proportions of up to 20 mol % and groups with m=10 to 40 being present only in proportions of below 5 mol %.

4. The monofilaments of claim 3 wherein, in the structural units of the polyester of the core, $A^1$ is 1,4-phenylene and $D^1$ is ethylene and in this polyester the structural units I and III account for at least 85 mol % of all structural units.

5. The monofilaments of claim 3 wherein, in the structural units of the polyester of the core, $A^1$ is 2,6-naphthylene and $D^1$ is ethylene and in this polyester the structural units I and III account for at least 85 mol % of all structural units.

6. The monofilaments of claim 3 wherein, in the structural units of the polyester of the core, $A^1$ is 2,6-naphthylene and 1,4-biphenyldiyl and $D^1$ is ethylene and in this polyester the structural units I and III account for at least 85 mol % of all structural units.

7. The monofilaments of claim 6 wherein the 2,6-naphthylene and 1,4-biphenyldiyl groups $A^1$ are present in a molar ratio of not more than 3:1.

8. The monofilaments of claim 3 wherein, in the structural units of the polyester of the core, $A^1$ is 1,4-phenylene and $D^1$ is 1,4-bismethylenecyclohexane and in this polyester the structural units I and III account for at least 85 mol % of all structural units.

9. The monofilaments of claim 3 wherein the polyester of the core has a specific viscosity of 0.55 to 1.6, measured in a 1% strength by weight solution of the polyesters in dichloroacetic acid at 25° C.

10. The monofilaments of claim 1 wherein the polymer material of the polyester mixture of the sheath contains 1 to 99% by weight of the thermoplastic polyester and 1 to 99% by weight of the thermoplastic polyurethane.

11. The monofilaments of claim 1 wherein the polyester of the polyester mixture of the sheath contains at least 70 mol %, based on the totality of all polyester structural units, of structural units derived from aromatic dicarboxylic acids and from aliphatic diols, and not more than 30 mol %, based on the totality of all polyester structural units, of dicarboxylic acid units which differ from the aromatic dicarboxylic acid units which form the predominant portion of the dicarboxylic acid units or are derived from araliphatic dicarboxylic acids having one or more fused or unfused aromatic nuclei, or from cyclic or acyclic aliphatic dicarboxylic acids having in total 4 to 12 carbon atoms, and diol units derived from aliphatic diols and which differ from the diol units which form the predominant portion of the diol units, or from branched or longer-chain diols having 3 to 10 carbon atoms, or from cyclic diols, or from diols which contain ether groups or, from polyglycol having a molecular weight of about 500–2000.

12. The monofilaments of claim 1 wherein the polyester of the polyester mixture of the sheath, based on the totality of all polyester structural units, is composed of 35 to 50 mol % of units of the formula —CO—$A^1$—CO— (I)

0 to 15 mol % of units of the formula —CO—$A^2$—CO— (II)

35 to 50 mol % of units of the formula —O—$D^1$—O— (III)

0 to 15 mol % of units of the formula —O—$D^2$—O— (IV)

and 0 to 25 mol % of units of the formula —O—$A^3$—CO— (V)

where $A^1$ denotes aromatic radicals having 5 to 12 carbon atoms, $A^2$ denotes aromatic radicals differing from $A^1$ or araliphatic radicals having 5 to 16 carbon atoms or cyclic or acyclic aliphatic radicals having 2 to 10 carbon atoms, $A^3$ denotes aromatic radicals having 5 to 12 carbon atoms, $D^1$ denotes alkylene or polymethylene groups having 2 to 4 carbon atoms or cycloalkane or dimethylenecycloalkane groups having 6 to 10 carbon atoms, $D^2$ denotes non-$D^1$ alkylene or polymethylene groups having 3 to 4 carbon atoms or cycloalkane or dimethylenecycloalkane groups having 6 to 10 carbon atoms or straight-chain or branched alkanediyl groups having 4 to 16 carbon atoms or radicals of the formula $—(C_2H_4—O)_m—C_2H_4—$, where m is an integer from 1 to 40, with m=1 or 2 for proportions of up to 20 mol % and groups with m=10 to 40 being present only in proportions of below 5 mol %.

13. The monofilaments of claim 12 wherein, in the structural units of the polyester of the polyester mixture of the sheath, $A^1$ denotes 1,4-phenylene and 1,3-phenylene and $D^1$ denotes ethylene, the molar ratio of 1,4- and 1,3-phenylene being chosen such that the polyester has a melting point within the range from 220° to 240° C. and that, in this polyester, the structural units I and III account for at least 85 mol % of all structural units.

14. The monofilaments of claim 1 wherein the polyester present in the polyester mixture of the sheath has a specific viscosity of 0.55 to 1.6, measured in a 1% strength by weight solution of the polyesters in dichloroacetic acid at 25° C.

15. The monofilaments of claim 1 wherein the polyester of the core and the polyester present in the polyester mixture of the sheath have a melting point between 220° to 240° C.

16. The monofilaments of claim 1 wherein the polyester of the core and the polyester of the polyester mixture of the sheath have the same chemical composition.

17. The monofilaments of claim 1 wherein the polyester of the core and the polyester of the polyester mixture of the sheath contain no more than 60 meq/kg of capped carboxyl end groups and less than 5 meq/kg of free carboxyl end groups.

18. The monofilaments of claim 1 wherein the polyester of the core and the polyester of the polyester mixture of the sheath have carboxyl end groups capped by reaction with mono- or bis- or polycarbodiimides.

19. The monofilaments of claim 1 wherein the polyester contains cocondensed groups of the formula VIII

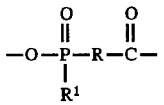

(VIII)

where R is alkylene or polymethylene having 2 to 6 carbon atoms or phenyl, and $R^1$ is alkyl having 1 to 6 carbon atoms, aryl or aralkyl.

20. The monofilaments of claim 1 wherein the elastomeric polyurethane of the polyester mixture of the sheath has a shear modulus of 8 to 80 MPa within the temperature range from 20° to 60° C., a mechanical loss factor tan(δ) of $0.8\times10^{-2}$ to $1.2\times10^{-1}$ within the temperature range from 20° to 60° C., a Shore hardness A of 82 to 100, a Shore hardness D of 30 to 60, a tensile strength of 32 to 42 MPa, a breaking extension of 420 to 520%, and an impact toughness of 32 to 45%.

21. The monofilaments of claim 1 wherein the elastomeric polyurethane of the polyester mixture of the sheath $$+CO—NH—R^1—NH—CO—R^2+_n \quad (IX)$$

conforms to the idealized formula IX where $R^1$ is a bivalent aromatic or araliphatic radical having 6 to 18 carbon atoms with a substituted or unsubstituted aromatic ring or with two fused or unfused, substituted or unsubstituted aromatic rings, $R^2$ is a polyether unit of the formula X

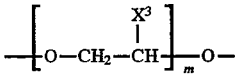

(X)

where $X^3$ is hydrogen or methyl, and m is from 10 to 100 or $R^2$ is the radical of polytetrahydrofuran or a unit of the formula XI $$+O—R^3—O—CO—R^4—CO+_p+O—R^3+_q O— \quad (XI)$$

where $R^3$ is straight-chain or branched alkanediyl or oxyalkanediyl having 2 to 8 carbon atoms, selected from the group consisting of ethylene, 1,3-propanediyl, 1,4-butanediyl, 1,6-hexanediyl, 2-ethyl-1,6-hexanediyl, 2,2-dimethyl-1,3-propanediyl or the bivalent oxaalkanediyl radicals derived from diethylene glycol or triethylene glycol, $R^4$ is alkanediyl having 2 to 6 cycloalkanediyl such as 1,4- or 1,3-cyclohexanediyl or a bivalent aromatic radical having 6 to 12 carbon atoms, p is a number chosen such that the polyester unit of the formula (XI) has a molecular weight of 1000 to 2000, and q is 0 or 1.

22. The monofilaments of claim 1 having a linear density of 1 to 24400 dtex and a round, elliptical or n-cornered cross-sectional shape, the elliptical shape having a ratio of major axis to minor axis of up to 10:1.

23. The monofilaments of claim 1 having an initial modulus at 25° C. of above 10 N/tex, a tenacity of above 18 cN/tex, and a 180° C. dry heat shrinkage of above 0.5%.

24. The monofilaments of claim 1 wherein the polyester of the core and the polyester mixture of the sheath contain up to 10% by weight of nonpolymeric substances selected from the group consisting of modifying additives, fillers, delustrants, pigments, dyes, and stabilizers including UV absorbers, antioxidants, hydrolysis, light and temperature stabilizers.

25. The monofilaments of claim 1 wherein the polyester of the core and the polyester mixture of the sheath contain different dyes.

* * * * *

UNITED STATES PATENT AND TRADEMARK OFFICE

CERTIFICATE OF CORRECTION

PATENT NO. :5,652,057
DATED :July 29, 1997
INVENTOR(S) :Rex Delker

It is certified that error appears in the above-indentified patent and that said Letters Patent is hereby corrected as shown below:

Column 2, line 60, "4,4," should read -- 4,4' --

Column 3, line 4, "4,4," should read -- 4,4' --; and last line, "95" should read -- 95% --
.

Column 4, line 2, "95" should read -- 95% --; and line 54, "2 6" should read -- 2,6 --.

Column 6, line 47, "kith" should read -- with --.

Column 15, line 39, "165°0" should read -- 165° --.

Signed and Sealed this

Eighteenth Day of August, 1998

Bruce Lehman

*Attest:*

BRUCE LEHMAN

*Attesting Officer*

*Commissioner of Patents and Trademarks*